US007542896B2

(12) United States Patent
Schuijers et al.

(10) Patent No.: US 7,542,896 B2
(45) Date of Patent: Jun. 2, 2009

(54) AUDIO CODING/DECODING WITH SPATIAL PARAMETERS AND NON-UNIFORM SEGMENTATION FOR TRANSIENTS

(75) Inventors: Erik Gosuinus Petrus Schuijers, Eindhoven (NL); Arnoldus Werner Johannes Oomen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 695 days.

(21) Appl. No.: 10/520,872

(22) PCT Filed: Jul. 1, 2003

(86) PCT No.: PCT/IB03/03041

§ 371 (c)(1),
(2), (4) Date: Jan. 11, 2006

(87) PCT Pub. No.: WO2004/008806

PCT Pub. Date: Jan. 22, 2004

(65) Prior Publication Data

US 2005/0177360 A1 Aug. 11, 2005

(30) Foreign Application Priority Data

Jul. 16, 2002 (EP) ..... 02077871

(51) Int. Cl.
*G10L 19/00* (2006.01)
*G10L 21/04* (2006.01)

(52) U.S. Cl. ..... 704/201; 704/218; 704/500

(58) Field of Classification Search ..... 704/200, 704/200.1, 201, 205, 206, 211, 216, 218, 704/500, 501
See application file for complete search history.

(56) References Cited

U.S. PATENT DOCUMENTS 5,278,909 A * 1/1994 Edgar ..... 381/17
5,388,181 A * 2/1995 Anderson et al. ..... 704/200.1
5,451,954 A * 9/1995 Davis et al. ..... 341/200
5,649,054 A * 7/1997 Oomen et al. ..... 704/229
5,684,923 A * 11/1997 Suzuki et al. ..... 704/229
5,848,391 A * 12/1998 Bosi et al. ..... 704/200.1
6,049,766 A * 4/2000 Laroche ..... 704/216
6,430,529 B1 * 8/2002 Huang ..... 704/229

(Continued)

FOREIGN PATENT DOCUMENTS

EP 1107232 A2 6/2001

(Continued)

OTHER PUBLICATIONS

Breebaart, "Binaural processing model based on contralateral inhibition.I. Model structure", The Journal of the Acoustical Society of America, vol. 110, No. 2, pp. 1074-1088, Aug. 2001.

(Continued)

*Primary Examiner*—Martin Lerner

(57) ABSTRACT

In binaural stereo coding, only one monaural channel is encoded. An additional layer holds the parameters to retrieve the left and right signal. An encoder is disclosed which links transient information extracted from the mono encoded signal to parametric multi-channel layers to provide increased performance. Transient positions can either be directly derived from the bit-stream or be estimated from other encoded parameters (e.g. window-switching flag in mp3).

17 Claims, 3 Drawing Sheets

U.S. PATENT DOCUMENTS

| | | | | |
|---|---|---|---|---|
| 6,611,603 | B1 * | 8/2003 | Norris et al. | 381/309 |
| 6,636,830 | B1 * | 10/2003 | Princen et al. | 704/204 |
| 6,691,082 | B1 * | 2/2004 | Aguilar et al. | 704/219 |
| 6,778,953 | B1 * | 8/2004 | Edler et al. | 704/200.1 |
| 6,826,525 | B2 * | 11/2004 | Hilpert et al. | 704/200.1 |
| 6,915,255 | B2 * | 7/2005 | Watanabe | 704/200.1 |
| 6,925,434 | B2 * | 8/2005 | Oomen et al. | 704/206 |
| 6,931,291 | B1 * | 8/2005 | Alvarez-Tinoco et al. | 700/94 |
| 7,181,019 | B2 * | 2/2007 | Breebaart et al. | 381/23 |
| 7,197,454 | B2 * | 3/2007 | Van Der Kerkhof et al. | 704/219 |
| 7,212,872 | B1 * | 5/2007 | Smith et al. | 700/94 |
| 7,292,901 | B2 * | 11/2007 | Baumgarte et al. | 381/23 |
| 7,319,756 | B2 * | 1/2008 | Oomen et al. | 380/236 |
| 7,460,993 | B2 * | 12/2008 | Chen et al. | 704/230 |
| 2002/0178012 | A1 * | 11/2002 | Wang et al. | 704/503 |
| 2003/0035553 | A1 * | 2/2003 | Baumgarte et al. | 381/94.2 |
| 2003/0115052 | A1 * | 6/2003 | Chen et al. | 704/230 |
| 2004/0162721 | A1 * | 8/2004 | Oomen et al. | 704/203 |
| 2005/0187760 | A1 * | 8/2005 | Oomen et al. | 704/203 |

FOREIGN PATENT DOCUMENTS

| | | | |
|---|---|---|---|
| WO | WO97/21211 | A1 | 6/1997 |
| WO | WO99/04498 | A2 | 1/1999 |
| WO | WO01/69593 | A1 | 9/2001 |
| WO | WO01/89086 | A1 | 11/2001 |

OTHER PUBLICATIONS

Breebaart, "Binaural processing model based on the contralateral inhibition. II. Dependence on spectral parameters", J. Acoust. Soc. Am 110, pp. 1089-1104, Aug. 2001.

Breebaart, Binaural processing model based on contralateral inhibition. II. Dependence on temporal parameters, J. Acoust. Soc. Am 110, pp. 1105-1117, Aug. 2001.

"Spatial audio", Apr. 22, 2002.

"Signal synthesizing" Apr. 15, 2003.

* cited by examiner

AUDIO CODING/DECODING WITH SPATIAL PARAMETERS AND NON-UNIFORM SEGMENTATION FOR TRANSIENTS

FIELD OF THE INVENTION

The present invention relates to audio coding.

BACKGROUND OF THE INVENTION

In traditional waveform based audio coding schemes such as MPEG-LII, mp3 and AAC (MPEG-2 Advanced Audio Coding), stereo signals are encoded by encoding two monaural audio signals into one bit-stream. However, by exploiting inter-channel correlation and irrelevancy with techniques such as mid/side stereo coding and intensity coding bit rate savings can be made.

In the case of mid/side stereo coding, stereo signals with a high amount of mono content can be split into a sum $M=(L+R)/2$ and a difference $S=(L-R)/2$ signal. This decomposition is sometimes combined with principle component analysis or time-varying scale-factors. The signals are then coded independently, either by a parametric coder or a waveform coder (e.g. transform or subband coder). For certain frequency regions this technique can result in a slightly higher energy for either the M or S signal. However, for certain frequency regions a significant reduction of energy can be obtained for either the M or S signal. The amount of information reduction achieved by this technique strongly depends on the spatial properties of the source signal. For example, if the source signal is monaural, the difference signal is zero and can be discarded. However, if the correlation of the left and right audio signals is low (which is often the case for the higher frequency regions), this scheme offers only little advantage.

In the case of intensity stereo coding, for a certain frequency region, only one signal $I=(L+R)/2$ is encoded along with intensity information for the L and R signal. At the decoder side this signal I is used for both the L and R signal after scaling it with the corresponding intensity information. In this technique, high frequencies (typically above 5 kHz) are represented by a single audio signal (i.e., mono), combined with time-varying and frequency-dependent scale-factors.

Parametric descriptions of audio signals have gained interest during the last years, especially in the field of audio coding. It has been shown that transmitting (quantized) parameters that describe audio signals requires only little transmission capacity to re-synthesize a perceptually equal signal at the receiving end. However, current parametric audio coders focus on coding monaural signals, and stereo signals are often processed as dual mono.

EP-A-1107232 discloses a parametric coding scheme to generate a representation of a stereo audio signal which is composed of a left channel signal and a right channel signal. To efficiently utilize transmission bandwidth, such a representation contains information concerning only a monaural signal which is either the left channel signal or the right channel signal, and parametric information. The other stereo signal can be recovered based on the monaural signal together with the parametric information. The parametric information comprises localization cues of the stereo audio signal, including intensity and phase characteristics of the left and the right channel.

In binaural stereo coding, similar to intensity stereo coding, only one monaural channel is encoded. Additional side information holds the parameters to retrieve the left and right signal. European Patent Application No. 02076588.9 filed April, 2002 discloses a parametric description of multi-channel audio related to a binaural processing model presented by Breebaart et al in "Binaural processing model based on contralateral inhibition. I. Model setup", J. Acoust. Soc. Am., 110, 1074-1088, August 2001 and "Binaural processing model based on contralateral inhibition. II. Dependence on spectral parameters", J. Acoust. Soc. Am., 110, 1089-1104, August 2001, and "Binaural processing model based on contralateral inhibition. III. Dependence on temporal parameters", J. Acoust. Soc. Am., 110, 1105-1117, August 2001 discloses a binaural processing model. This comprises splitting an input audio signal into several band-limited signals, which are spaced linearly at an (Equivalent Rectangular Bandwidth) ERB-rate scale. The bandwidth of these signals depends on the center frequency, following the ERB rate. Subsequently, for every frequency band, the following properties of the incoming signals are analyzed:

the interaural level difference (ILD) defined by the relative levels of the band-limited signal stemming from the left and right ears, the interaural time (or phase) difference (ITD or IPD), defined by the interaural delay (or phase shift) corresponding to the peak in the interaural cross-correlation function, and the (dis)similarity of the waveforms that can not be accounted for by ITDs or ILDs, which can be parameterized by the maximum interaural cross-correlation (i.e., the value of the cross-correlation at the position of the maximum peak).

It is therefore known from the above disclosures that spatial attributes of any multi-channel audio signal may be described by specifying the ILD, ITD (or IPD) and maximum correlation as a function of time and frequency.

This parametric coding technique provides reasonably good quality for general audio signals. However, particularly for signals having a higher non-stationary behaviour, e.g. castanets, harpsichord, glockenspiel, etc, the technique suffers from pre-echo artifacts.

It is an object of this invention to provide an audio coder and decoder and corresponding methods that mitigate the artifacts related to parametric multi-channel coding.

DISCLOSURE OF THE PRESENT INVENTION

According to the present invention there is provided a method of coding an audio signal and a method of decoding a bitstream.

According to an aspect of the invention, spatial attributes of multi-channel audio signals are parameterized. Preferably, the spatial attributes comprise: level differences, temporal differences and correlations between the left and right signal.

Using the invention, transient positions either directly or indirectly are extracted from a monaural signal and are linked to parametric multi-channel representation layers. Utilizing this transient information in a parametric multi-channel layer provides increased performance.

It is acknowledged that in many audio coders, transient information is used to guide the coding process for better performance. For example, in the sinusoidal coder described in WO01/69593-A1 transient positions are encoded in the bitstream. The coder may use these transient positions for adaptive segmentation (adaptive framing) of the bitstream. Also, in the decoder, these positions may be used to guide the windowing for the sinusoidal and noise synthesis. However, these techniques have been limited to monaural signals.

In a preferred embodiment of the present invention, when decoding a bitstream where the monaural content has been produced by such a sinusoidal coder, the transient positions can be directly derived from the bit-stream.

In waveform coders, such as mp3 and AAC, transient positions are not directly encoded in the bitstream; rather it is assumed in the case of mp3, for example, that transient intervals are marked by switching to shorter window-lengths (window switching) in the monaural layer and so transient positions can be estimated from parameters such as the mp3 window-switching flag.

BRIEF DESCRIPTION OF THE DRAWINGS

Preferred embodiments of the present invention will now be described, by way of example, with reference to the accompanying drawings, in which.

DESCRIPTION OF THE PREFERRED EMBODIMENT

Figure 1:
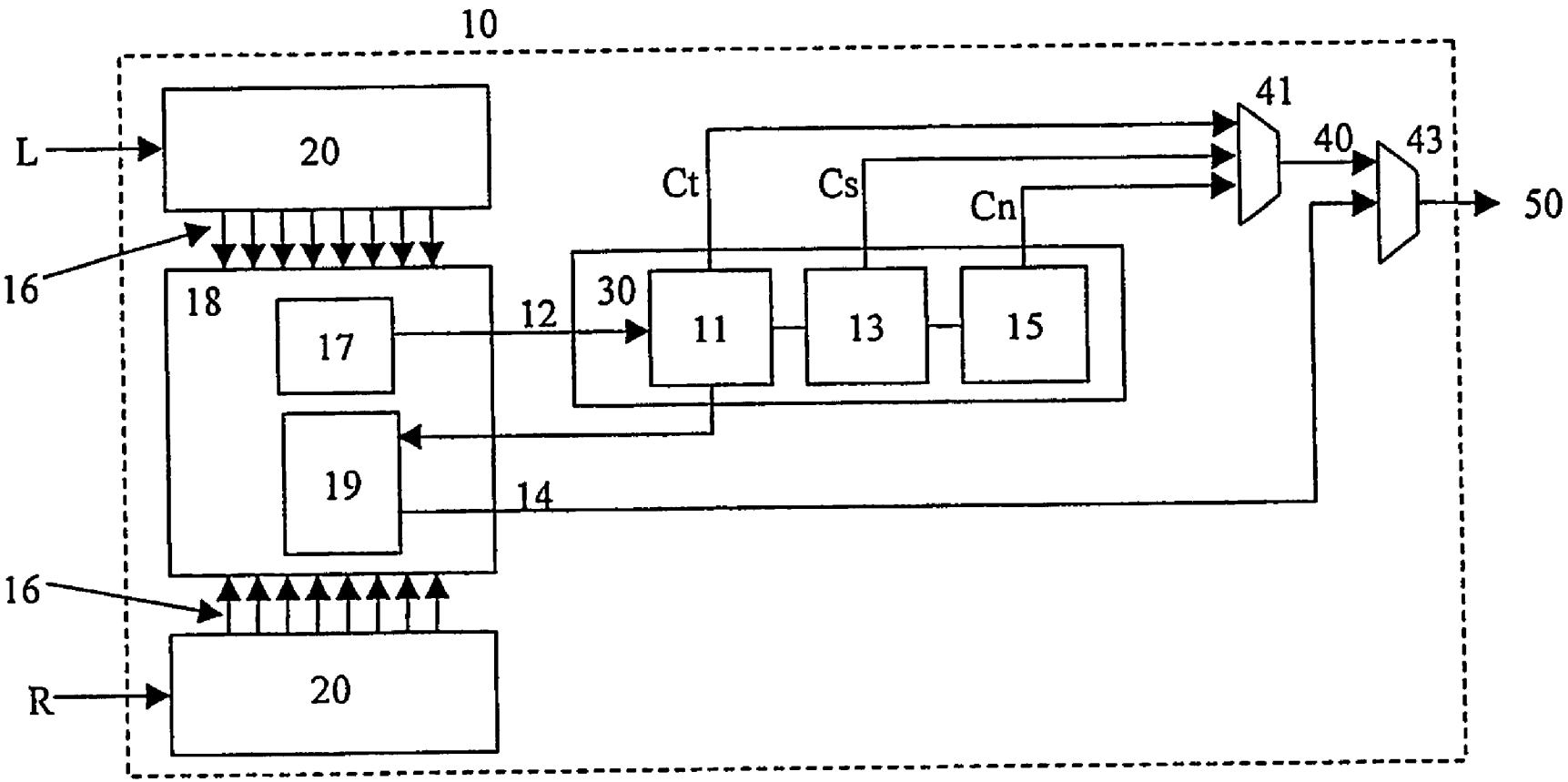
FIG. 1 is a schematic diagram illustrating an encoder according to an embodiment of the invention.

Referring now to FIG. 1, there is shown an encoder 10 according to a preferred embodiment of the present invention for encoding a stereo audio signal comprising left (L) and right (R) input signals. In the preferred embodiment, as in European Patent Application No. 02076588.9 filed April, 2002, the encoder describes a multi-channel audio signal with:

one monaural signal 12, comprising a combination of the multiple input audio signals, and for each additional auditory channel, a set of spatial parameters 14 comprising: two localization cues (ILD, and ITD or IPD) and a parameter (r) that describes the similarity or dissimilarity of the waveforms that cannot be accounted for by ILDs and/or ITDs (e.g., the maximum of the cross-correlation function) preferably for every time/frequency slot.

The set(s) of spatial parameters can be used as an enhancement layer by audio coders. For example, a mono signal is transmitted if only a low bit-rate is allowed, while by including the spatial enhancement layer(s), a decoder can reproduce stereo or multi-channel sound.

It will be seen that while in this embodiment, a set of spatial parameters is combined with a monaural (single channel) audio coder to encode a stereo audio signal, the general idea can be applied to n-channel audio signals, with n>1. Thus, the invention can in principle be used to generate n channels from one mono signal, if (n−1) sets of spatial parameters are transmitted. In such cases, the spatial parameters describe how to form the n different audio channels from the single mono signal. Thus, in a decoder, by combining a subsequent set of spatial parameters with the monaural coded signal, a subsequent channel is obtained.

Analysis Methods

In general, the encoder 10 comprises respective transform modules 20 which split each incoming signal (L,R) into subband signals 16 (preferably with a bandwidth which increases with frequency). In the preferred embodiment, the modules 20 use time-windowing followed by a transform operation to perform time/frequency slicing, however, time-continuous methods could also be used (e.g., filterbanks).

The next steps for determination of the sum signal 12 and extraction of the parameters 14 are carried out within an analysis module 18 and comprise:

finding the level difference (ILD) of corresponding subband signals 16, finding the time difference (ITD or IPD) of corresponding sub-band signals 16, and describing the amount of similarity or dissimilarity of the waveforms which cannot be accounted for by ILDs or ITDs.

Analysis of ILDs

The ILD is determined by the level difference of the signals at a certain time instance for a given frequency band. One method to determine the ILD is to measure the rms value of the corresponding frequency band of both input channels and compute the ratio of these rms values (preferably expressed in dB).

Analysis of the ITDs

The ITDs are determined by the time or phase alignment which gives the best match between the waveforms of both channels. One method to obtain the ITD is to compute the cross-correlation function between two corresponding subband signals and searching for the maximum. The delay that corresponds to this maximum in the cross-correlation function can be used as ITD value.

A second method is to compute the analytic signals of the left and right subband (i.e., computing phase and envelope values) and use the phase difference between the channels as IPD parameter. Here, a complex filterbank (e.g. an FFT) is used and by looking at a certain bin (frequency region) a phase function can be derived over time. By doing this for both left and right channel, the phase difference IPD (rather then cross-correlating two filtered signals) can be estimated.

Analysis of the Correlation

The correlation is obtained by first finding the ILD and ITD that gives the best match between the corresponding subband signals and subsequently measuring the similarity of the waveforms after compensation for the ITD and/or ILD. Thus, in this framework, the correlation is defined as the similarity or dissimilarity of corresponding subband signals which can not be attributed to ILDs and/or ITDs. A suitable measure for this parameter is the maximum value of the cross-correlation function (i.e., the maximum across a set of delays). However, also other measures could be used, such as the relative energy of the difference signal after ILD and/or ITD compensation compared to the sum signal of corresponding subbands (preferably also compensated for ILDs and/or ITDs). This difference parameter is basically a linear transformation of the (maximum) correlation.

Parameter Quantization

An important issue of transmission of parameters is the accuracy of the parameter representation (i.e., the size of quantization errors), which is directly related to the necessary transmission capacity and the audio quality. In this section, several issues with respect to the quantization of the spatial parameters will be discussed. The basic idea is to base the quantization errors on so-called just-noticeable differences (JNDs) of the spatial cues. To be more specific, the quantization error is determined by the sensitivity of the human auditory system to changes in the parameters. Since it is well known that the sensitivity to changes in the parameters strongly depends on the values of the parameters itself, the following methods are applied to determine the discrete quantization steps.

Quantization of ILDs

It is known from psychoacoustic research that the sensitivity to changes in the ILD depends on the ILD itself. If the ILD is expressed in dB, deviations of approximately 1 dB from a reference of 0 dB are detectable, while changes in the order of 3 dB are required if the reference level difference amounts 20 dB. Therefore, quantization errors can be larger if the signals of the left and right channels have a larger level difference. For example, this can be applied by first measuring the level difference between the channels, followed by a non-linear (compressive) transformation of the obtained level difference and subsequently a line quantization process, or by using a lookup table for the available ILD values which have a non-linear distribution. In the preferred embodiment, ILDs (in dB) are quantized to the closest value out of the following set I:

$$I=[-19-16-13-10-8-6-4-2\ 0\ 2\ 4\ 6\ 8\ 10\ 13\ 16\ 19]$$

Quantization of the ITDs

The sensitivity to changes in the ITDs of human subjects can be characterized as having a constant phase threshold. This means that in terms of delay times, the quantization steps for the ITD should decrease with frequency. Alternatively, if the ITD is represented in the form of phase differences, the quantization steps should be independent of frequency. One method to implement this would be to take a fixed phase difference as quantization step and determine the corresponding time delay for each frequency band. This ITD value is then used as quantization step. In the preferred embodiment, ITD quantization steps are determined by a constant phase difference in each subband of 0.1 radians (rad). Thus, for each subband, the time difference that corresponds to 0.1 rad of the subband center frequency is used as quantization step. For frequencies above 2 kHz, no ITD information is transmitted.

Another method would be to transmit phase differences which follow a frequency-independent quantization scheme. It is also known that above a certain frequency, the human auditory system is not sensitive to ITDs in the fine structure waveforms. This phenomenon can be exploited by only transmitting ITD parameters up to a certain frequency (typically 2 kHz).

A third method of bitstream reduction is to incorporate ITD quantization steps that depend on the ILD and/or the correlation parameters of the same subband. For large ILDs, the ITDs can be coded less accurately. Furthermore, if the correlation it very low, it is known that the human sensitivity to changes in the ITD is reduced. Hence larger ITD quantization errors may be applied if the correlation is small. An extreme example of this idea is to not transmit ITDs at all if the correlation is below a certain threshold.

Quantization of the Correlation

The quantization error of the correlation depends on (1) the correlation value itself and possibly (2) on the ILD. Correlation values near +1 are coded with a high accuracy (i.e., a small quantization step), while correlation values near 0 are coded with a low accuracy (a large quantization step). In the preferred embodiment, a set of non-linearly distributed correlation values (r) are quantized to the closest value of the following ensemble R:

$$R=[1\ 0.95\ 0.9\ 0.82\ 0.75\ 0.6\ 0.3\ 0]$$

and this costs another 3 bits per correlation value.

If the absolute value of the (quantized) ILD of the current subband amounts 19 dB, no ITD and correlation values are transmitted for this subband. If the (quantized) correlation value of a certain subband amounts zero, no ITD value is transmitted for that subband.

In this way, each frame requires a maximum of 233 bits to transmit the spatial parameters. With an update framelength of 1024 samples and a sampling rate of 44.1 kHz, the maximum bitrate for transmission amounts less than 10.25 kbit/s [233*44100/1024=10.034 kbit/s]. (It should be noted that using entropy coding or differential coding, this bitrate can be reduced further.)

A second possibility is to use quantization steps for the correlation that depend on the measured ILD of the same subband: for large ILDs (i.e., one channel is dominant in terms of energy), the quantization errors in the correlation become larger. An extreme example of this principle would be to not transmit correlation values for a certain subband at all if the absolute value of the ILD for that subband is beyond a certain threshold.

Detailed Implementation

In more detail, in the modules 20, the left and right incoming signals are split up in various time frames (2048 samples at 44.1 kHz sampling rate) and windowed with a square-root Hanning window. Subsequently, FFTs are computed. The negative FFT frequencies are discarded and the resulting FFTs are subdivided into groups or subbands 16 of FFT bins. The number of FFT bins that are combined in a subband g depends on the frequency: at higher frequencies more bins are combined than at lower frequencies. In the current implementation, FFT bins corresponding to approximately 1.8 ERBs are grouped, resulting in 20 subbands to represent the entire audible frequency range. The resulting number of FFT bins S[g] of each subsequent subband (starting at the lowest frequency) is S=[4 4 4 5 6 8 9 12 13 17 21 25 30 38 45 55 68 82 100 477]

Thus, the first three subbands contain 4 FFT bins, the fourth subband contains 5 FFT bins, etc. For each subband, the analysis module 18 computes corresponding ILD, ITD and correlation (r). The ITD and correlation are computed simply by setting all FFT bins which belong to other groups to zero, multiplying the resulting (band-limited) FFTs from the left and right channels, followed by an inverse FFT transform. The resulting cross-correlation function is scanned for a peak within an interchannel delay between −64 and +63 samples. The internal delay corresponding to the peak is used as ITD value, and the value of the cross-correlation function at this peak is used as this subband's interaural correlation. Finally, the ILD is simply computed by taking the power ratio of the left and right channels for each subband.

Generation of the Sum Signal

The analyser 18 contains a sum signal generator 17 which performs phase correction (temporal alignment) on the left and right subbands before summing the signals. This phase correction follows from the computed ITD for that subband and comprises delaying the left-channel subband with ITD/2 and the right-channel subband with −ITD/2. The delay is performed in the frequency domain by appropriate modification of the phase angles of each FFT bin. Subsequently, a summed signal is computed by adding the phase-modified versions of the left and right subband signals. Finally, to compensate for uncorrelated or correlated addition, each subband of the summed signal is multiplied with sqrt(2/(1+r)), with correlation (r) of the corresponding subband to generate the final sum signal 12. If necessary, the sum signal can be converted to the time domain by (1) inserting complex conjugates at negative frequencies, (2) inverse FFT, (3) windowing, and (4) overlap-add.

Given the representation of the sum signal 12 in the time and/or frequency domain as described above, the signal can be encoded in a monaural layer 40 of a bitstream 50 in any number of conventional ways. For example, a mp3 encoder can be used to generate the monaural layer 40 of the bitstream. When such an encoder detects rapid changes in an input signal, it can change the window length it employs for that particular time period so as to improve time and or frequency localization when encoding that portion of the input signal. A window switching flag is then embedded in the bitstream to indicate this switch to a decoder which later synthesizes the signal. For the purposes of the present invention, this window switching flag is used as an estimate of a transient position in an input signal.

In the preferred embodiment, however, a sinusoidal coder 30 of the type described in WO01/69593-A1 is used to generate the monaural layer 40. The coder 30 comprises a transient coder 11, a sinusoidal coder 13 and a noise coder 15.

When the signal 12 enters the transient coder 11, for each update interval, the coder estimates if there is a transient signal component and its position (to sample accuracy) within the analysis window. If the position of a transient signal component is determined, the coder 11 tries to extract (the main part of) the transient signal component. It matches a shape function to a signal segment preferably starting at an estimated start position, and determines content underneath the shape function, by employing for example a (small) number of sinusoidal components and this information is contained in the transient code CT.

The sum signal 12 less the transient component is furnished to the sinusoidal coder 13 where it is analyzed to determine the (deterministic) sinusoidal components. In brief, the sinusoidal coder encodes the input signal as tracks of sinusoidal components linked from one frame segment to the next. The tracks are initially represented by a start frequency, a start amplitude and a start phase for a sinusoid beginning in a given segment—a birth. Thereafter, the track is represented in subsequent segments by frequency differences, amplitude differences and, possibly, phase differences (continuations) until the segment in which the track ends (death) and this information is contained in the sinusoidal code CS.

The signal less both the transient and sinusoidal components is assumed to mainly comprise noise and the noise analyzer 15 of the preferred embodiment produces a noise code CN representative of this noise. Conventionally, as in, for example, WO 01/89086-A1 a spectrum of the noise is modeled by the noise coder with combined AR (auto-regressive) MA (moving average) filter parameters (pi,qi) according to an Equivalent Rectangular Bandwidth (ERB) scale. Within a decoder, the filter parameters are fed to a noise synthesizer, which is mainly a filter, having a frequency response approximating the spectrum of the noise. The synthesizer generates reconstructed noise by filtering a white noise signal with the ARMA filtering parameters (pi,qi) and subsequently adds this to the synthesized transient and sinusoid signals to generate an estimate of the original sum signal.

Figure 4:
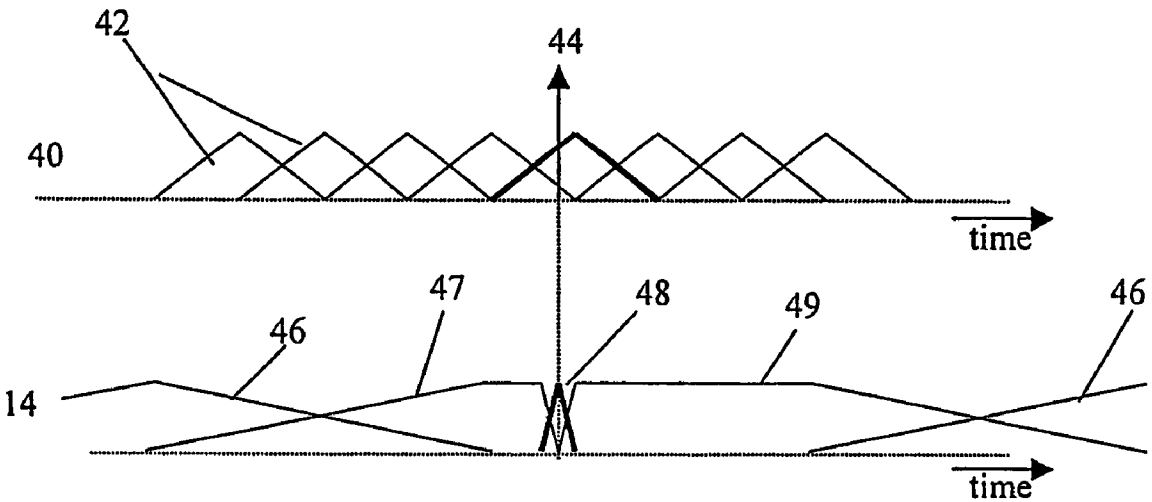
FIG. 4 shows an example of the exploitation of the transient position from the monaural encoded layer for decoding a parametric multi-channel layer.

The multiplexer 41 produces the monaural audio layer 40 which is divided into frames 42 which represent overlapping time segments of length 16 ms and which are updated every 8 ms, FIG. 4. Each frame includes respective codes CT, CS and CN and in a decoder the codes for successive frames are blended in their overlap regions when synthesizing the monaural sum signal. In the present embodiment, it is assumed that each frame may only include up to 1 transient code CT and an example of such a transient is indicated by the numeral 44.

Generation of the Sets Spatial Parameters

The analyser 18 further comprises a spatial parameter layer generator 19. This component performs the quantization of the spatial parameters for each spatial parameter frame as described above. In general, the generator 19 divides each spatial layer channel 14 into frames 46 which represent overlapping time segments of length 64 ms and which are updated every 32 ms, FIG. 4. Each frame includes respective ILD, ITD or IPD and correlation coefficients and in the decoder the values for successive frames are blended in their overlap regions to determine the spatial layer parameters for any given time when synthesizing the signal.

In the preferred embodiment, transient positions detected by the transient coder 11 in the monaural layer 40 (or by a corresponding analyser module in the summed signal 12) are used by the generator 19 to determine if non-uniform time segmentation in the spatial parameter layer(s) 14 is required. If the encoder is using an mp3 coder to generate the monaural layer, then the presence of a window switching flag in the monaural stream is used by the generator as an estimate of a transient position.

Referring to FIG. 4, the generator 19 may receive an indication that a transient 44 needs to be encoded in one of the subsequent frames of the monaural layer corresponding to the time window of the spatial parameter layer(s) for which it is about to generate frame(s). It will be seen that because each spatial parameter layer comprises frames representing overlapping time segments, for any given time the generator will be producing two frames per spatial parameter layer. In any case, the generator proceeds to generate spatial parameters for a frame representing a shorter length window 48 around the transient position. It should be noted that this frame will be of the same format as normal spatial parameter layer frames and calculated in the same manner except that it relates to a shorter time window around the transient position 44. This short window length frame provides increased time resolution for the multi-channel image. The frame(s) which would otherwise have been generated before and after the transient window frame are then used to represent special transition windows 47, 49 connecting the short transient window 48 to the windows 46 represented by normal frames.

In the preferred embodiment, the frame representing the transient window 48 is an additional frame in the spatial representation layer bitstream 14, however, because transients occur so infrequently, it adds little to the overall bitrate. It is nonetheless critical that a decoder reading a bitstream produced using the preferred embodiment takes into account this additional frame as otherwise the synchronization of the monaural and the spatial representation layers would be compromised.

Figure 3:
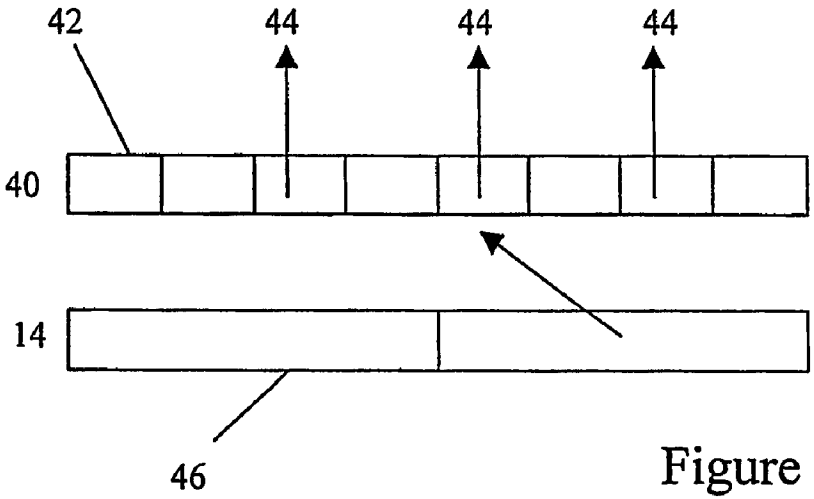
FIG. 3 shows transient positions encoded in respective sub-frames of a monaural signal and the corresponding frames of a multi-channel layer.

It is also assumed in the present embodiment, because transients occur so infrequently, that only one transient within the window length of a normal frame 46 may be relevant to the spatial parameter layer(s) representation. Even if two transients do occur during the period of a normal frame, it is assumed that the non-uniform segmentation will occur around the first transient as indicated in FIG. 3. Here three transients 44 are shown encoded in respective monaural frames. However, it is the second rather than the third transient which will be used to indicate that the spatial parameter layer frame representing the same time period (shown below these transients) should be used as a first transition window, prior to the transient window derived from an additional spatial parameter layer frame inserted by the encoder and in turn followed by a frame which represents a second transition window.

Nonetheless, it is possible that not all transient positions encoded in the monaural layer will be relevant for the spatial parameter layer(s) as is the case of the first transient 44 in FIG. 3. Thus, the bit-stream syntax for either the monaural or the spatial representation layer can include indicators of transient positions that are relevant or not for the spatial representation layer.

In the preferred embodiment, it is the generator 19 which makes the determination of the relevance of a transient for the spatial representation layer by looking at the difference between the estimated spatial parameters (ILD, ITD and correlation (r)) derived from a larger window (e.g. 1024 samples) that surrounds the transient location 44 and those derived from the shorter window 48 around the transient location. If there is a significant change between the parameters from the short and coarse time intervals, then the extra spatial parameters estimated around the transient location are inserted in an additional frame representing the short time window 48. If there is little difference, the transient location is not selected for use in the spatial representation and an indication is included in the bitstream accordingly.

Finally, once the monaural 40 and spatial representation 14 layers have been generated, they are in turn written by a multiplexer 43 to a bitstream 50. This audio stream 50 is in turn furnished to e.g. a data bus, an antenna system, a storage medium etc.

Synthesis

Figure 2:
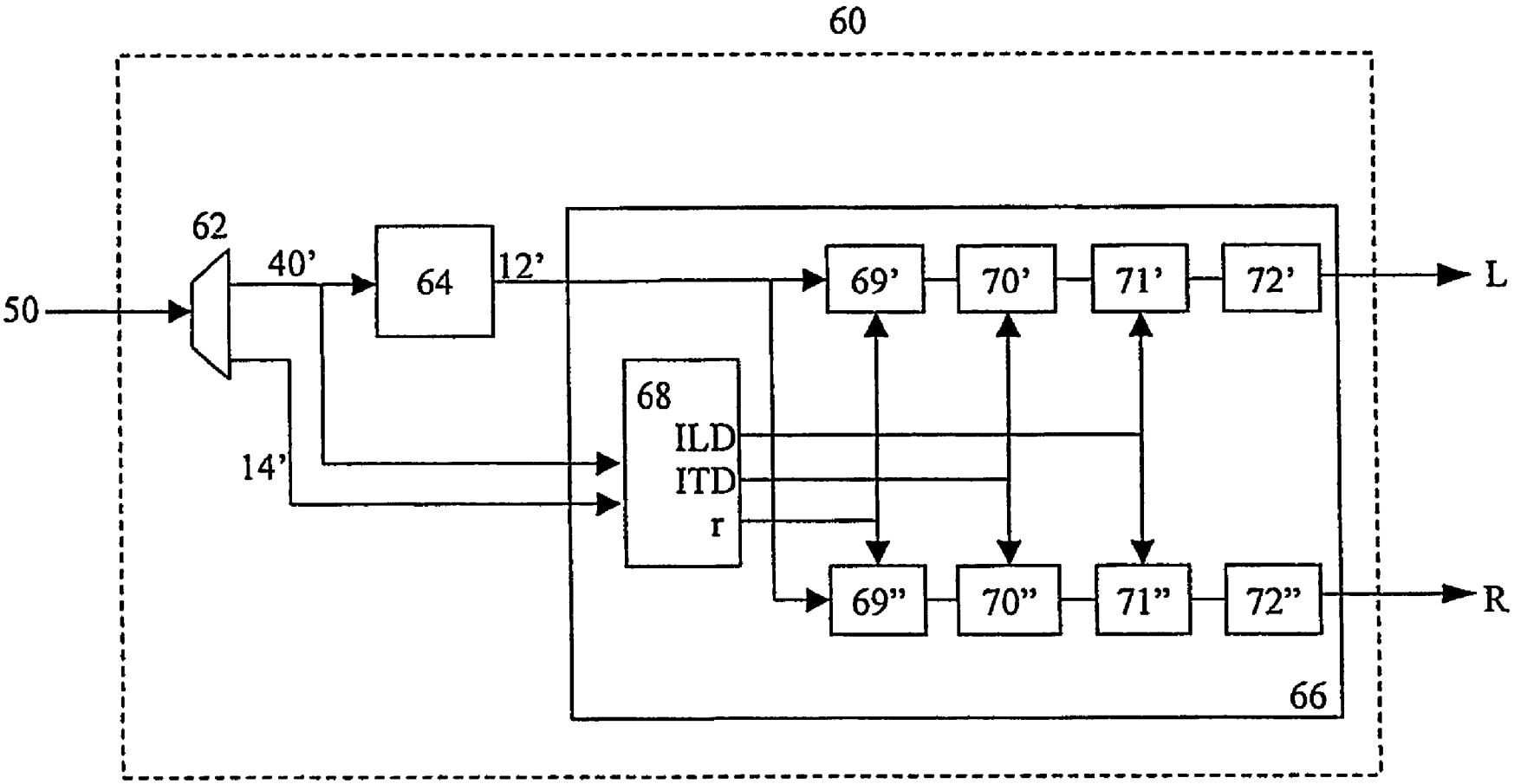
FIG. 2 is a schematic diagram illustrating a decoder according to an embodiment of the invention.

Referring now to FIG. 2, a decoder 60 includes a de-multiplexer 62 which splits an incoming audio stream 50 into the monaural layer 40' and in this case a single spatial representation layer 14'. The monaural layer 40' is read by a conventional synthesizer 64 corresponding to the encoder which generated the layer to provide a time domain estimation of the original summed signal 12'.

Spatial parameters 14' extracted by the de-multiplexer 62 are then applied by a post-processing module 66 to the sum signal 12' to generate left and right output signals. The post-processing module of the preferred embodiment also reads the monaural layer 40' information to locate the positions of transients in this signal. (Alternatively, the synthesizer 64 could provide such an indication to the post-processor; however, this would require some slight modification of the otherwise conventional synthesizer 64.)

In any case, when the post-processor detects a transient 44 within a monaural layer frame 42 corresponding to the normal time window of the frame of the spatial parameter layer(s) 14' which it is about to process, it knows that this frame represents a transition window 47 prior to a short transient window 48. The post-processor knows the time location of the transient 44 and so knows the length of the transition window 47 prior to the transient window and also that of the transition window 49 after the transient window 48. In the preferred embodiment, the post-processor 66 includes a blending module 68 which, for the first portion of the window 47, mixes the parameters for the window 47 with those of the previous frame in synthesizing the spatial representation layer(s). From then until the beginning of the transient window 48, only the parameters for the frame representing the window 47 are used in synthesizing the spatial representation layer(s). For the first portion of the transient window 48 the parameters of the transition window 47 and the transient window 48 are blended and for the second portion of the transient window 48 the parameters of the transition window 49 and the transient window 48 are blended and so on until the middle of the transition window 49 after which inter-frame blending continues as normal.

As explained above, the spatial parameters used at any given time are a blend of either the parameters for two normal window 46 frames, a blend of parameters for a normal 46 and a transition frame 47,49, those of a transition window frame 47,49 alone or a blend of those of a transition window frame 47,49 and those of a transient window frame 48. Using the syntax of the spatial representation layer, the module 68 can select those transients which indicate non-uniform time segmentation of the spatial representation layer and at these appropriate transient locations, the short length transient windows provide for better time localisation of the multi-channel image.

Within the post-processor 66, it is assumed that a frequency-domain representation of the sum signal 12' as described in the analysis section is available for processing. This representation may be obtained by windowing and FFT operations of the time-domain waveform generated by the synthesizer 64. Then, the sum signal is copied to left and right output signal paths. Subsequently, the correlation between the left and right signals is modified with a decorrelator 69', 69" using the parameter r. For a detailed description on how this can be implemented, reference is made to European patent application, titled "Signal synthesizing", filed on 12 Jul. 2002 of which D. J. Breebaart is the first inventor (our reference PHNL020639). That European patent application discloses a method of synthesizing a first and a second output signal from an input signal, which method comprises filtering the input signal to generate a filtered signal, obtaining the correlation parameter, obtaining a level parameter indicative of a desired level difference between the first and the second output signals, and transforming the input signal and the filtered signal by a matrixing operation into the first and second output signals, where the matrixing operation depends on the correlation parameter and the level parameter. Subsequently, in respective stages 70', 70", each subband of the left signal is delayed by –ITD/2, and the right signal is delayed by ITD/2 given the (quantized) ITD corresponding to that subband. Finally, the left and right subbands are scaled according to the ILD for that subband in respective stages 71', 71". Respective transform stages 72', 72" then convert the output signals to the time domain, by performing the following steps: (1) inserting complex conjugates at negative frequencies, (2) inverse FFT, (3) windowing, and (4) overlap-add.

The preferred embodiments of decoder and encoder have been described in terms of producing a monaural signal which is a combination of two signals—primarily in case only the monaural signal is used in a decoder. However, it should be seen that the invention is not limited to these embodiments and the monaural signal can correspond with a single input and/or output channel with the spatial parameter layer(s) being applied to respective copies of this channel to produce the additional channels.

It is observed that the present invention can be implemented in dedicated hardware, in software running on a DSP (Digital Signal Processor) or on a general-purpose computer. The present invention can be embodied in a tangible medium such as a CD-ROM or a DVD-ROM carrying a computer program for executing an encoding method according to the invention. The invention has particular application in the fields of Internet download, Internet Radio, Solid State Audio (SSA), bandwidth extension schemes, for example, mp3PRO, CT-aacPlus, and most audio coding schemes.

The invention claimed is:

1. A method of coding an audio signal, the method comprising the acts of:

generating a monaural signal, analyzing the spatial characteristics of at least two audio channels to obtain one or more sets of spatial parameters for successive time slots, responsive to said monaural signal containing a transient at a given transient time, determining a non-uniform time segmentation of said sets of spatial parameters for a period including said transient time, determining a relevance of said transient by looking at a difference between first estimated spatial parameters derived from a first window that surrounds a transient location of said transient and second estimated spatial parameters derived from a second window around said transient location, the second window being shorter than the first window;

generating an encoded signal comprising the monaural signal and the one or more sets of spatial parameters; and if said difference is larger than a threshold, then inserting in the encoded signal additional parameters estimated around said transient location.

2. The method according to claim 1 wherein said monaural signal comprises a combination of at least two input audio channels.

3. The method according to claim 1 wherein said monaural signal is generated with a parametric sinusoidal coder, said coder generating frames corresponding to successive time slots of said monaural signal, at least some of said frames including parameters representing a transient occurring in the respective time slots represented by said frames.

4. The method according to claim 1 wherein said monaural signal is generated with a waveform encoder, said waveform encoder determining a non-uniform time segmentation of said monaural signal for a period including said transient time.

5. The method according to claim 4 wherein said waveform encoder is an mp3 encoder.

6. The method according to claim 1 wherein said sets of spatial parameters include at least two localization cues.

7. The method according to claim 6 wherein said sets of spatial parameters further comprises a parameter that describes a similarity or dissimilarity of waveforms that cannot be accounted for by the localization cues.

8. The method according to claim 7 wherein the parameter is a maximum of a cross-correlation function.

9. The method of claim 1, wherein the additional parameters are inserted in an additional frame representing the second window around the transient location.

10. The method of claim 1, further comprising the act of including in the encoded signal an indication that the transient location is not selected for use in a spatial representation if the difference is below the threshold.

11. The method of claim 1, wherein the transient is a first transient in a frame containing a plurality of transients.

12. An encoder for coding an audio signal, the encoder comprising:

a sum generator configured to generate a monaural signal, an analyzer configured to analyze spatial characteristics of at least two audio channels to obtain one or more sets of spatial parameters for successive time slots, a transient coder, responsive to said monaural signal containing a transient at a given transient time, configured to determine a non-uniform time segmentation of said sets of spatial parameters for a period including said transient time, a parameter generator configured to determine a relevance of said transient by looking at a difference between first estimated spatial parameters derived from a first window that surrounds a transient location of said transient and second estimated spatial parameters derived from a second window around said transient location, the second window being shorter than the first window; and a multiplexer configured to generate an encoded signal comprising the monaural signal and the one or more sets of spatial parameters;

wherein the parameter generator is further configured to insert in the encoded signal additional parameters estimated around said transient location if said difference is larger than a threshold.

13. An apparatus for supplying an audio signal, the apparatus comprising:

an input for receiving an audio signal, an encoder as claimed in claim 12 for encoding the audio signal to obtain an encoded audio signal, and an output for supplying the encoded audio signal.

14. A storage medium on which an encoded signal has been stored, the signal comprising:

a monaural signal containing at least one indication of a transient occurring at a given time in said monaural signal; and one or more sets of spatial parameters for successive time slots of said signal, said sets of spatial parameters providing a non-uniform time segmentation of audio signal for a period including said transient time;

wherein the one or more sets of spatial parameters is indicative of a difference being larger than a threshold, the difference being between first estimated spatial parameters derived from a first window that surrounds a transient location of said transient and second estimated spatial parameters derived from a second window around said transient location, the second window being shorter than the first window.

15. A method of decoding an encoded audio signal, the method comprising:

obtaining a monaural signal from the encoded audio signal, obtaining one or more sets of spatial parameters from the encoded audio signal, and responsive to said monaural signal containing a transient at a given time, determining a non-uniform time segmentation of said sets of spatial parameters for a period including said transient time, and applying the one or more sets of spatial parameters to the monaural signal to generate a multi-channel output signal, wherein the one or more sets of spatial parameters is indicative of a difference being larger than a threshold, the difference being between first estimated spatial parameters derived from a first window that surrounds a transient location of said transient and second estimated spatial parameters derived from a second window around said transient location, the second window being shorter than the first window.

16. A decoder for decoding an encoded audio signal comprising:

a de-multiplexer configured to obtain a monaural signal and one or more sets of spatial parameters from the encoded audio signal, and a post-processor, responsive to said monaural signal containing a transient at a given time, configured to determine a non-uniform time segmentation of said sets of spatial parameters for a period including said transient time, the post-processor being further configured to apply the one or more sets of spatial parameters to the monaural signal to generate a multi-channel output signal, wherein the one or more sets of spatial parameters is indicative of a difference being larger than a threshold, the difference being between first estimated spatial parameters derived from a first window that surrounds a transient location of said transient and second estimated spatial parameters derived from a second window around said transient location, the second window being shorter than the first window.

17. An apparatus for supplying a decoded audio signal, the apparatus comprising:

an input for receiving an encoded audio signal, a decoder as claimed in claim 16 for decoding the encoded audio signal to obtain a multi-channel output signal, an output for supplying or reproducing the multi-channel output signal.

* * * * *